US005870880A

United States Patent [19]

Romagnoli

[11] Patent Number: 5,870,880

[45] Date of Patent: Feb. 16, 1999

[54] MACHINE FOR PROVIDING INFUSION BAGS WITH FINGER TAB LABELS ATTACHED THERETO BY INTERCONNECTING THREADS AND LABELED INFUSION BAGS PRODUCED THEREBY

[75] Inventor: Andrea Romagnoli, San Lazzaro di Savena, Italy

[73] Assignee: I.M.A. Industria Macchine Automatiche S.P.A., Bologna, Italy

[21] Appl. No.: 750,052

[22] PCT Filed: Apr. 2, 1996

[86] PCT No.: PCT/IT96/00065

§ 371 Date: Dec. 4, 1996

§ 102(e) Date: Dec. 4, 1996

[87] PCT Pub. No.: WO96/31395

PCT Pub. Date: Oct. 10, 1996

[30] Foreign Application Priority Data

Apr. 4, 1995 [IT] Italy ..... BO95A0148

[51] Int. Cl.[6] ..... B65B 29/04; B65B 61/14; B65B 61/24

[52] U.S. Cl. ..... 53/134.2; 53/120; 206/0.5; 493/226; 493/375; 493/388

[58] Field of Search ..... 53/413, 134.2, 53/429, 116, 120, 139.4; 206/0.5; 493/88, 226, 375, 380, 386, 388

[56] References Cited

U.S. PATENT DOCUMENTS

| | | | |
|---|---|---|---|
| 1,857,625 | 5/1932 | Doble | 53/134.2 |
| 2,307,998 | 1/1943 | Eaton . | |
| 3,143,834 | 8/1964 | Irmscher | 53/413 X |
| 3,566,573 | 3/1971 | Irmscher | 53/413 X |
| 3,774,369 | 11/1973 | Klar | 53/134.2 |
| 4,853,071 | 8/1989 | Romagnoli | 53/134.2 |
| 4,856,257 | 8/1989 | Romagnoli | 53/413 X |
| 4,885,896 | 12/1989 | Romagnoli | 53/134.2 X |
| 4,929,299 | 5/1990 | Romagnoli | 53/134.2 X |
| 4,977,728 | 12/1990 | Rambold | 53/413 X |
| 5,527,419 | 6/1996 | Vernon et al. | 53/134.2 X |
| 5,580,408 | 12/1996 | Vernon et al. | 53/134.2 X |
| 5,657,712 | 8/1997 | Romagnoli | 53/134.2 X |

FOREIGN PATENT DOCUMENTS

| | | |
|---|---|---|
| 1 001 944 | 1/1957 | Germany . |
| 94/077630 | 4/1994 | WIPO . |

*Primary Examiner*—Horace M. Culver
*Attorney, Agent, or Firm*—Pillsbury, Madison & Sutro LLP

[57] ABSTRACT

Filter bags containing a substance from which to prepare an infusion are fashioned from tubular blanks of filter paper having an elongated appearance, each one filled with measured and separate quantities of the substance distributed along its length, which are doubled up and made secure, then provided with a label attached by a length of thread. A machine for automating the manufacture of such bags includes a wheel carrying grippers with radial arms, around which the thread is drawn peripherally as the grippers are indexed in turn through a station where the blank is folded double initially, a forming station at which the two joined ends are folded together to effect a closure, a cutting station at which the thread is divided into single lengths, a feed station supplying the labels, and a fastening station at which the length of thread is knotted both to the label and to the closure.

17 Claims, 7 Drawing Sheets

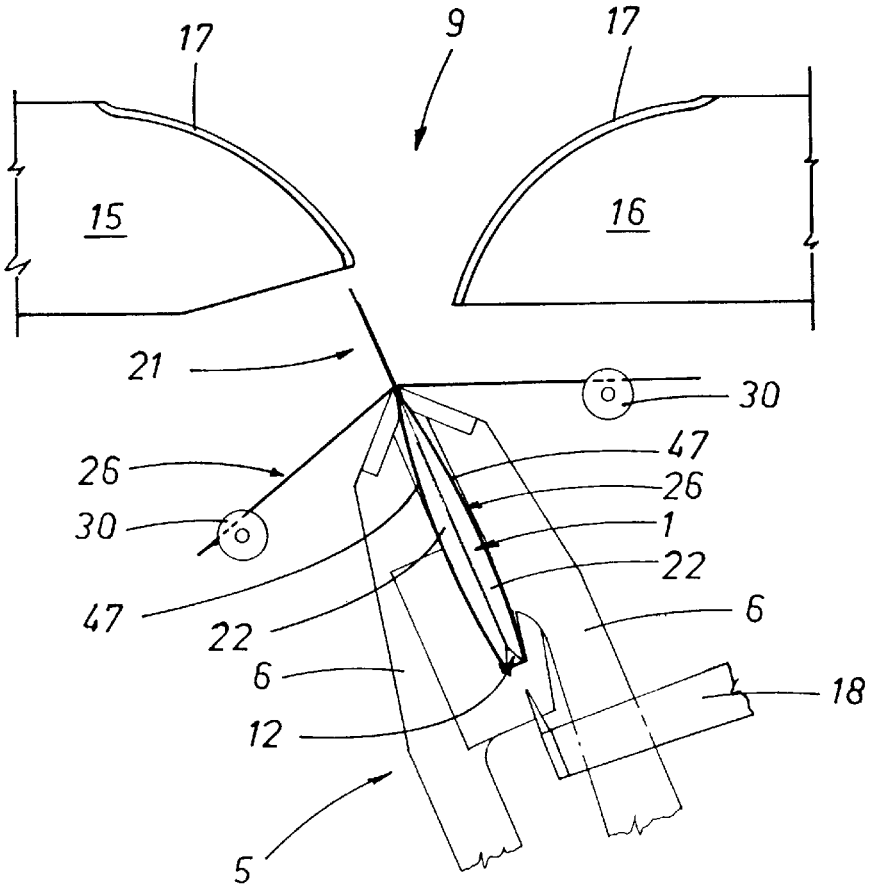
FIG2c
FIG2d
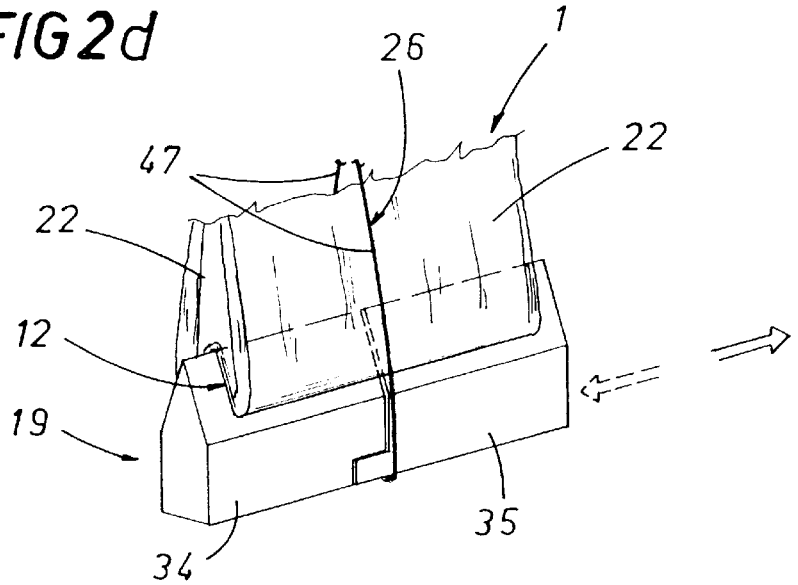

MACHINE FOR PROVIDING INFUSION BAGS WITH FINGER TAB LABELS ATTACHED THERETO BY INTERCONNECTING THREADS AND LABELED INFUSION BAGS PRODUCED THEREBY

This application is the national phase of international application PCT/IT96/00065 filed Apr. 2, 1996, which designated the U.S.

TECHNICAL FIELD

The present invention relates to a machine for the manufacture of filter bags each containing a substance with which to prepare an infusion and provided with a finger tab label attached by an interconnecting thread, the bags in question being of the type fashioned from tubular blanks of filter paper having an elongated appearance, each bag being filled with measured and separate quantities of the substance distributed along its length. The machine comprises a wheel carrying grippers with radial arms, capable of indexed rotation and operating in conjunction with:

an infeed station at which a tubular blank is taken up along a direction substantially tangential to the wheel;

a station at which the tubular blank is folded double by rotation about a pleat formed across a portion of the blank lying between the opposite ends, in such a way that the two resulting halves are brought together; the folding station is equipped with two stationary bearing elements disposed along the tangential direction and affording respective surfaces that converge toward the wheel, also with elements capable of movement between the stationary elements toward and away from the wheel, by which each tubular blank in turn is restrained from either side, taken up from the infeed station, folded in conjunction with the stationary elements and directed between the arms of the grippers.

The invention relates in particular to a type of filter bag in which the infusionable substance is localized in two envelopes created with folds applied to the paper from which the bag is fashioned.

BACKGROUND ART

Italian patent 1 207 630 discloses equipment for teaches the assembly of a filter bag coated with a film of heat-sealable thermoplastic material and having a label attached by a thread that is anchored at one end of the bag between two heat-sealed edges, then passed around and secured externally to the bag by a number of spot seals.

The manufacture of this type of bag dictates the use, at least to an extent, of paper or other material such as can be heat-sealed. Unfortunately there are certain considerations precluding the use of such materials, connected with the risk that substances released from the heat-sealed thermoplastic can migrate into the infusion following interaction with a liquid at high temperature.

A further drawback of this solution is discernible in the higher cost of heat-sealable paper as compared to normal filter paper.

U.S. Pat. No. 2,307,998 discloses a solution, belonging to the prior art, wherein the thread, the bag, and the finger tab label are interconnected by knots.

The formation of knots as taught by that patent does not favor automation of the manufacturing process to a speed that would be suitable for the industrial scale production of filter bags containing an infusionable substance; indeed as regards this aspect of the process, the industrial solution most widely adopted remains that of securing the thread with metal staples.

There is also a drawback with the solution of stapling, however, in that it introduces a foreign element into the infusion of which the presence is considered inappropriate for obvious reasons of hygiene. Moreover, the presence of a metal staple is undesirable by reason of the possible change in organoleptic properties of the infusion attributable to the metal.

Italian patent application n° B094A 000319, filed by I.M.A. INDUSTRIA MACCHINE AUTOMATICHES S.p.A., discloses a method of attaching a label to a filter bag by means of a special knot such as will allow the manufacture of bags, with respective finger tab labels, on industrial scale, and making no use of metal staples.

SUMMARY OF THE INVENTION

The object of the present invention is to provide a machine for the manufacture of filter bags incorporating no heat seals, in which a finger tab label is attached to each bag by way of a knotting operation performed at a station equipped specifically with means capable of implementing the method-referred to above.

The stated object is realized in a machine of which the features will become more evident in the light of the detailed description that follows and in light of the accompanying drawings, from which it is discernible not least that over and above the advantage of being able to manufacture the more desirable type of bag identified above, the machine has a simpler structural and mechanical embodiment than those of the machines referred to above, thanks to the elimination of two infeed functions typically required where metal staples are used in connecting the thread respectively to the label and to the bag.

This simplification brings further advantages in terms both of cost, and of the reliability of the machine overall.

An additional simplification derives from the particular arrangement and sequence of the work stations in the machine, obtained when the constructional elements of the solution are carried ultimately into effect, which is such that the thread can be passed around the bag practically without the need to include special parts designed specifically for the purpose: an advantage gained simply through judicious proportioning of the familiar elements present in all conventional machines of the type in question.

BRIEF DESCRIPTION OF THE DRAWINGS

The invention will now be described in detail, by way of example, with the aid of the accompanying drawings, in which:

FIGS. 2*a*, 2*b*, 2*c* and 2*d* illustrate a first detail of the machine, suitably enlarged and shown in a series of typical operating configurations;

DETAILED DESCRIPTION

Figure 1A:
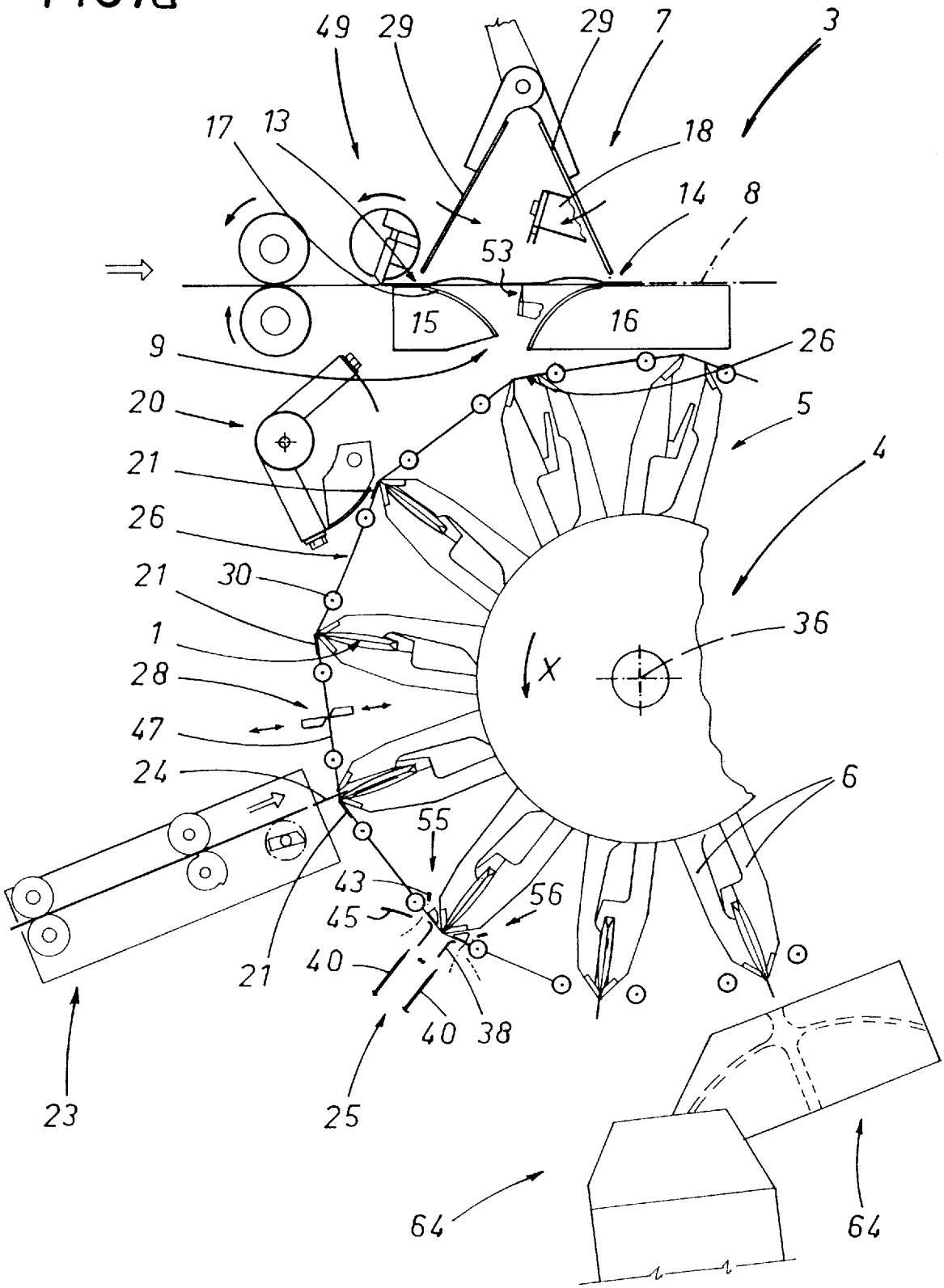
FIGS. 1*a* and 1*b* are partial elevations which when placed one alongside the other provide an overall view of the machine according to the invention, but in which certain parts are omitted better to reveal others.
Figure 1B:
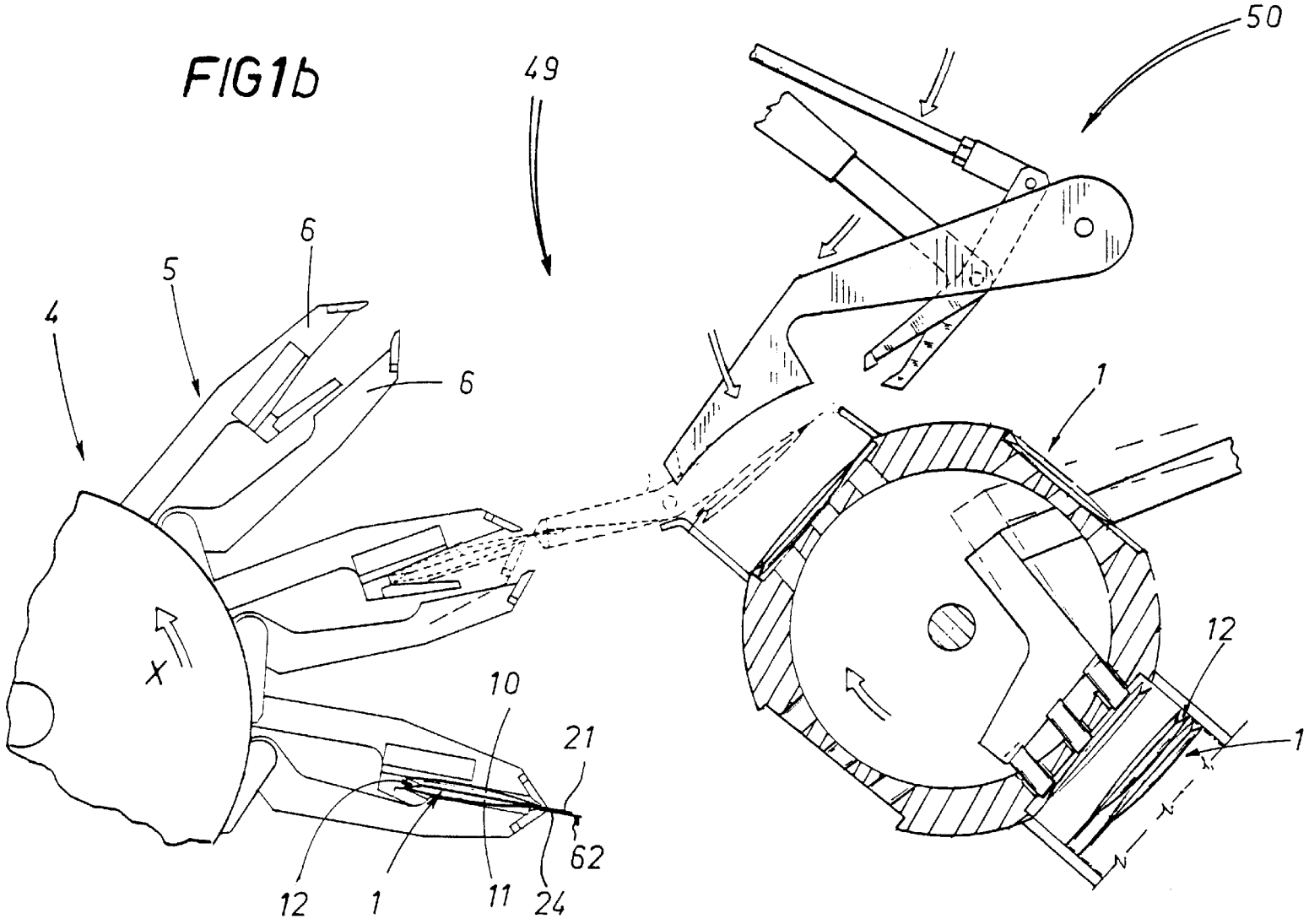
Figure 11:
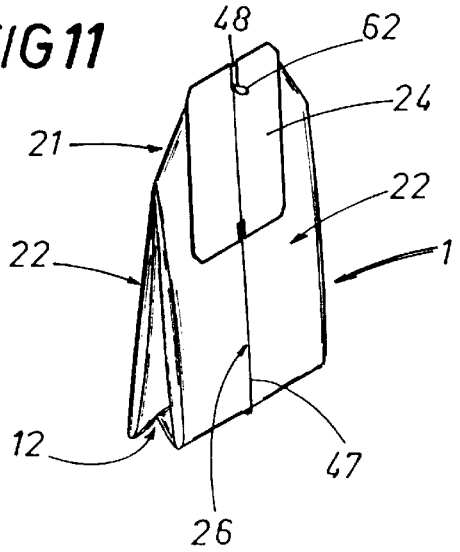
FIGS. 11 and 12 illustrate a filter bag obtained with the machine according to the invention.

With reference to FIGS. 1*a* and 1*b* of the drawings, the present invention relates to a machine 3 for the manufacture of filter bags 1 (FIG. 11) containing a substance with which to prepare an infusion, each furnished with a label 24 that serves also as a finger tab, attached by an interconnecting length 47 of thread 26 which, in order to prevent the label 24 from trailing loose is passed around the bag 1 and secured to a notch 48 provided by the label 24.

The filter bags 1 in question are fashioned from tubular blanks 2 of filter paper having an elongated appearance (FIGS. 2*a,* 2*b* and 2*c*), each filled initially along its length with measured and separate quantities of the infusionable substance.

The tubular blanks 2 are prepared at a section of the machine 3 denoted 49 (which is not central to the invention and therefore is indicated only in part in FIGS. 1*a* and 1*b*), by a special forming process of the type described and illustrated in patent DE 1 001 944.

Briefly, the process in question involves decoiling a continuous flat strip of filter paper, onto which measured quantities of the infusionable substance are dispensed at a selected distance one from the next, and bending the strip gradually in such a manner as to bring the two longitudinal edges together. The edges are secured by folding to obtain a continuous tube which then passes through a cutting station and is severed into discrete blanks 2, each containing two measures of the substance, which discrete blanks are conveyed to an infeed station 7.

At a given point beyond the section 49 where the tubular blanks 2 are prepared, the machine 2 comprises a wheel 4 equipped with grippers 4 having radial arms 6, which wheel is rotatable intermittently in such a way as to bring each of the grippers 5 in turn into association with:

the infeed station 7, toward which the tubular blanks 2 are advanced along a direction 8 substantially tangential to the wheel;

a folding station 9 at which each tubular blank 2 is bent double (FIGS. 1*a,* 2*a,* 2*b* and 2*c*);

a forming station 20 at which the ends of each tubular blank 2 are shaped into the folded top 21 of a closed bag 1 comprising two envelopes 22 (FIGS. 1*a,* 11 and 12);

a cutting station 28 at which a thread 26 serving to connect the bag 1 and the label 24 is severed (FIGS. 1*a,* 11 and 12);

a feed station 23 supplying the finger tab labels 24 (FIGS. 1*a,* 11 and 12);

a fastening station 25 at which a cut length 47 of thread 26 is secured to a label 24 and to a bag 1; and an outfeed station 50 at which the filter bags 1 are removed from the wheel 4 (FIG. 1*b*) and conveyed forward to undergo further steps of an individual or multiple wrapping process.

Once in position over the folding station 9 (FIGS. 2*a,* 2*b* and 2*c*), the tubular blank 2 is bent double from its initial rectilinear configuration into two halves 10 and 11 brought side by side as the result of being rotated about a pleat 12 of "W" profile formed across a portion of the blank 2 lying midway between the two opposite ends 13 and 14.

To this end, the folding station is equipped with two stationary bearing elements 15 and 16 disposed along the feed direction 8 followed by the tubular blanks 2, of which the surfaces 17 converge one toward another and both toward the wheel 4.

The station is also equipped with elements 18 and 19 serving to restrain the tubular blank 2 from either side and carrying matched dies 52 and 53 at the respective ends such as will impress the pleat 12 across the intermediate portion of the blank 2, which dies are capable of movement between the surfaces 17 of the stationary elements toward and away from the wheel 4 in such a manner that a blank 2 can be taken up from the infeed station 7, folded by interaction with the stationary surfaces 17 and transferred between the arms 6 of the gripper 5 waiting beneath.

In addition, the folding station 9 comprises a pair of pressure elements 29 which are capable of movement in coordination with the restraining elements 18 and 19, by which the opposite ends 13 and 14 of the tubular blank 2 are pinned flat against the surfaces 17 of the stationary bearing elements 15 and 16 in such a way as to prevent any escape of the infusionable substance (in a process that makes no use of heat seals, the blank 2 is still open at this stage) during the transfer from the infeed station 7 down through the folding station 9.

In a preferred embodiment of the machine, the movable pressure elements 29 interact with the stationary surfaces 17 only during the interval of time for which the bag 1 is in a state of acceleration when it is being transferred through the folding station 9 to the wheel 4. It will be appreciated that, in effect, as the tubular blank 2 decelerates before coming to rest between the arms 6 of the gripper 5, the contents will tend to be driven downward by the resulting forces of inertia and thus kept securely within the partly formed bag 1, which can therefore be released by the pressure elements 29.

It will be seen from FIGS. 1*a* and 1*b* that the thread 26 serving to connect the label 24 to the bag 1 is fed through between the folding station 9 and the wheel 4. The thread 26 is held across the gripper arms 6 (FIGS. 2*a,* 2*b* and 2*c*) by supporting elements 30 associated with the wheel 4 on either side of each gripper 5 and carried by the selfsame arms 6. More exactly, the elements 30 supporting the thread 26 provide friction surfaces 33 (FIG. 3) disposed in mutual opposition and loaded against a spring 51, which are arranged in such a way that the thread 26, drawn forward by the wheel 4 and yet free to slip, remains permanently tensioned across at least two successive supporting elements 30 belonging to the same gripper 5.

Figure 2A:
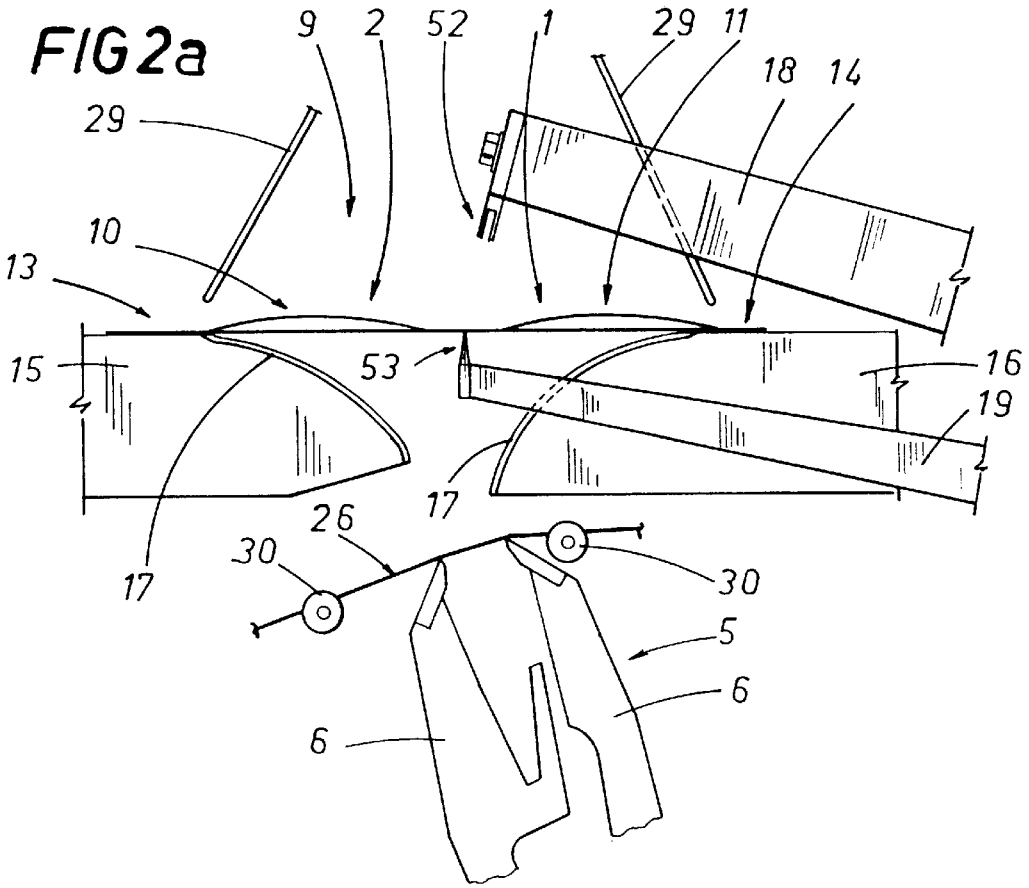

The interaction between the thread 26 and the folding station 9, in particular during the step of folding a tubular blank 2, is illustrated more fully in FIGS. 2*a,* 2*b* and 2*c*. Unwinding from a conventional reel and tensioned between the supporting elements 30, the thread 26 is intercepted by one of the two restraining elements 19 (that located between the blank 2 and the wheel 4) and drawn between the open arms 6 of a gripper 5 beneath.

Figure 2B:
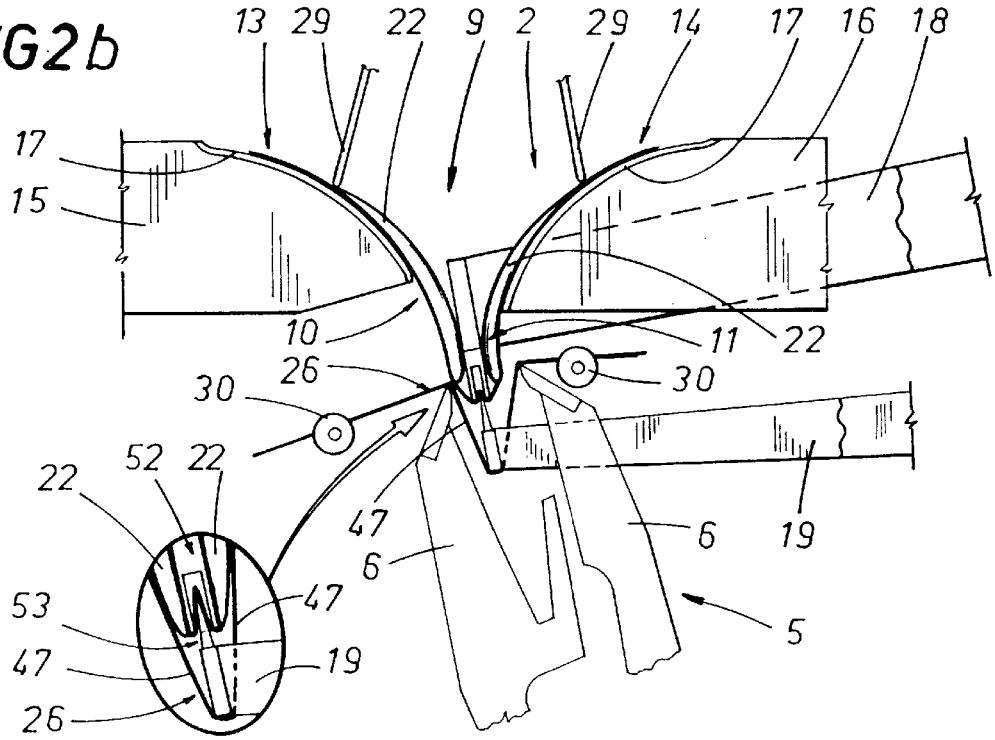

By embodying the restraining element 19 in two parts 34 and 35 which are designed to couple positively one with another in a direction parallel to the axis 36 of rotation of the wheel 4 (FIG. 2*d*), and which are capable of translational movement one relative to the other in the same parallel direction from an operating position in which the restraining element 19 lies between the bag 1 and the wheel 4 (FIG. 2*b*) to a non-operating position in which the two parts 34 and 35 are distanced from the wheel 4, it becomes possible for the thread 26 to disengage from the restraining element 19 once the thread 26 is drawn fully down. This allows the thread 26 to pass entirely around the bag 1 within the space encompassed by the arms 6 (FIG. 2*c*), so that when the arms are brought together, the wheel 4 remains free to index and take the bag 1 into the forming station 20 where the folded top 21 will be shaped.

As the bag 1 passes through the forming station 20, the folded top 21 is fashioned in two steps employing an entirely conventional procedure.

The bag moves away from the forming station 20 with the folded top 21 bent forward in the direction of rotation X of the wheel 4 through approximately 900 in relation to the main body of the bag 1, which remains firmly in place between the two arms 6 and continues to occupy a radial position relative to the wheel 4.

It will be seen that the thread 26 at this stage is held taut between the supporting elements 30 on either side of the gripper 5 and the respective arms 6.

As the bag 1 passes from the forming station 20 to the feed station 23 supplying the labels 24, the thread 26 passes through the aforementioned cutting station 28 and is severed at a point between two successive grippers 5, in the space separating the two respective supporting elements 30 that lie immediately adjacent along the periphery of the wheel 4. Each bag 1 will thus approach the feed station 23 together with a discrete length 47 of thread 26 looped around the bag itself and held by the supporting elements 30 on each side, which is already calculated as being long enough to pass fully around the bag and to extend beyond for a distance sufficient to make two knots securing the ends respectively to the bag 1 and to the label 24, as will be made clear in due course.

Once the bag I is in alignment with the feed station 23, the gripper 5 will open marginally so that a label 24 can be accommodated between the two arms 6, whereupon the label is bent backwards 90° relative to the direction of rotation X of the wheel 4, in a conventional manner.

In short, the bag I is carried beyond the label feed station 23 still held firmly between the gripper arms 6, with the folded top 21 bent forward, lying tangential to the part of the thread 26 extending from the gripper 5 to the adjacent supporting element 30, and the label 24 bent backwards and similarly disposed in relation to the thread on the opposite side of the gripper.

Figures 3, 4, 5, 6:
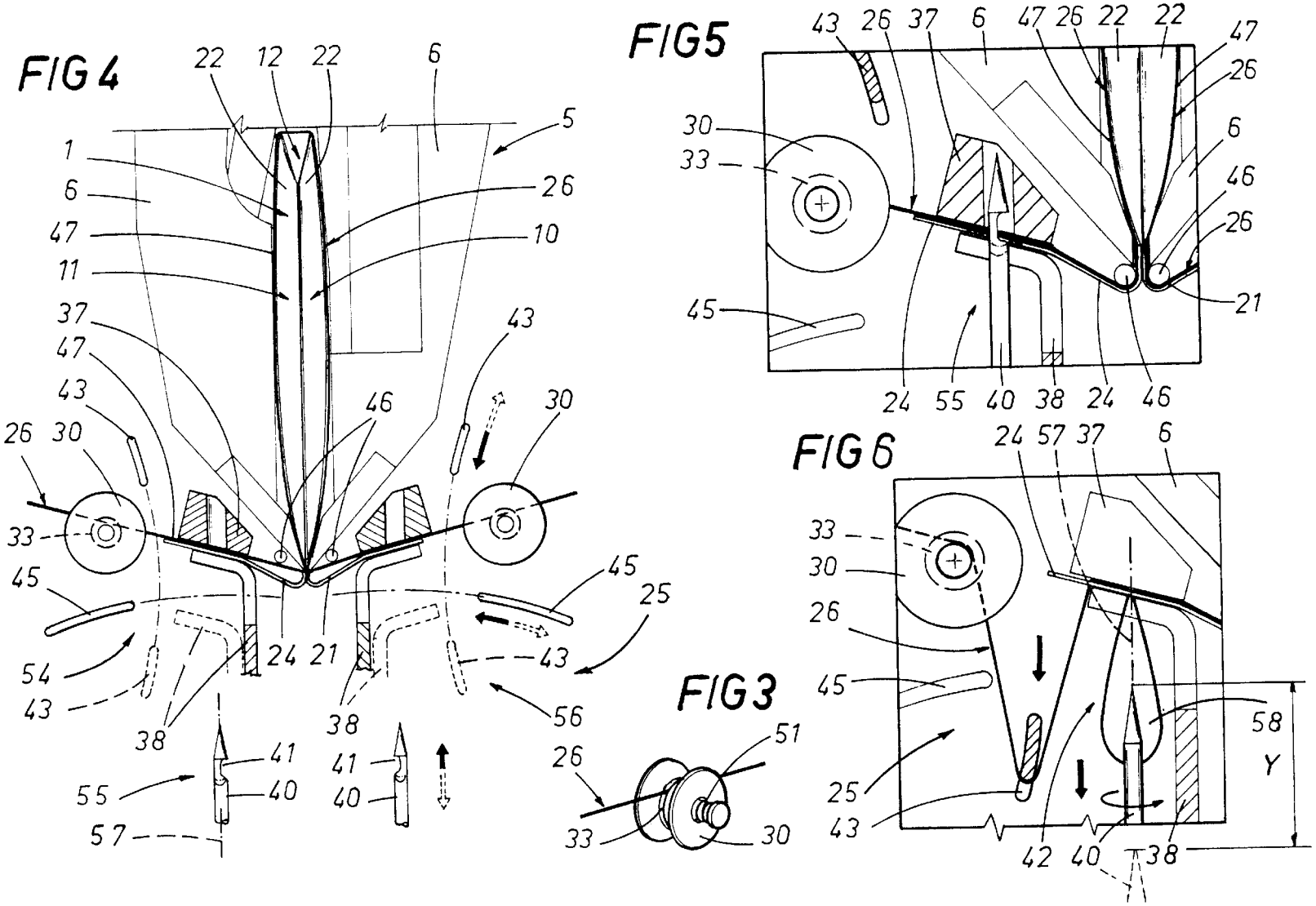
FIG. 3 illustrates one possible embodiment of a detail of the machine shown in FIGS. 1 and 2.
FIGS. 4, 5, 6, 7, 8, 9 and 10 are schematic illustrations indicating the sequence of steps by which a thread is knotted to the filter bag and to the label in the machine disclosed.

The bag 1 advances in this same configuration to the fastening station 25, which is illustrated more fully in FIG. 4, where the length 47 of thread 26 is secured to the label 24 and to the bag 1 at one and the same time through the agency of a knotting apparatus denoted 54.

The knotting apparatus 54 comprises two work heads 55 and 56 structured in such a way as to operate in identical manner on the folded top 21 and on the label 24.

For the sake of simplicity, reference is made in the drawings and in the course of the following description only to the work head 55 by which the thread 26 is knotted to the label 24, given that the details will apply in every aspect to the other head 56 which operates on the folded top 21 of the bag 1.

Figure 7:
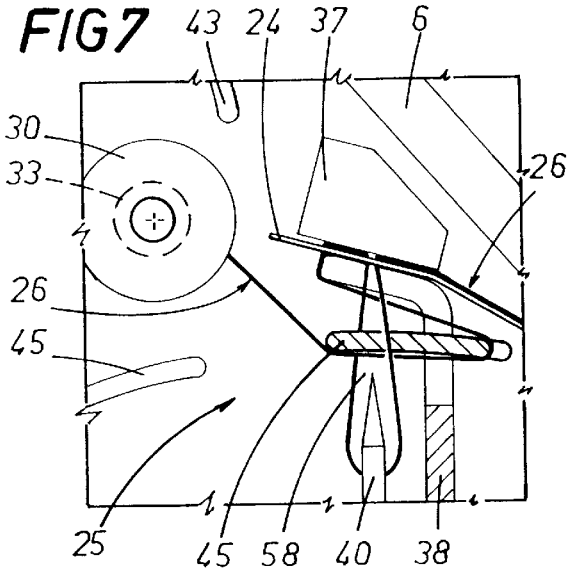
Figure 8:
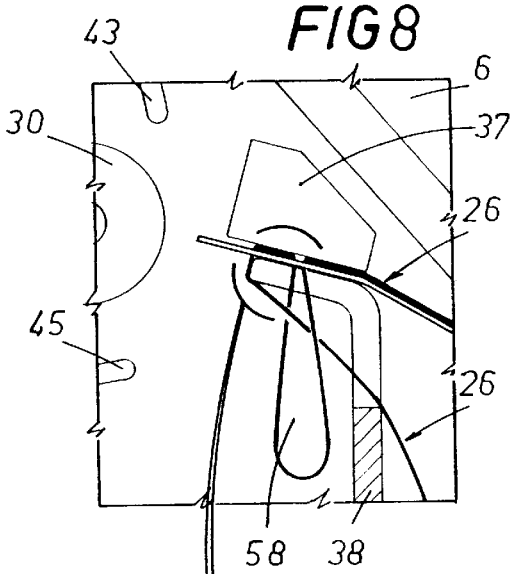
Figure 9:
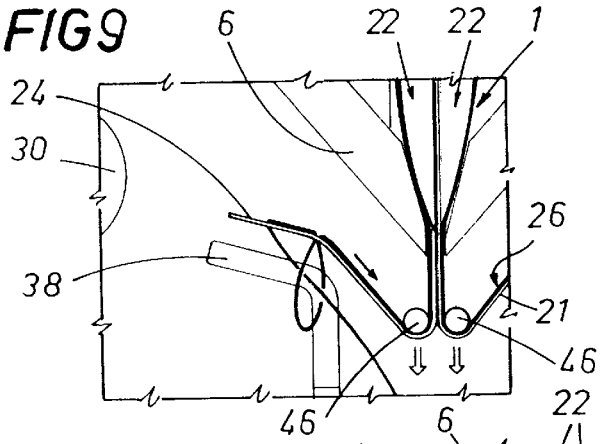
Figure 9:
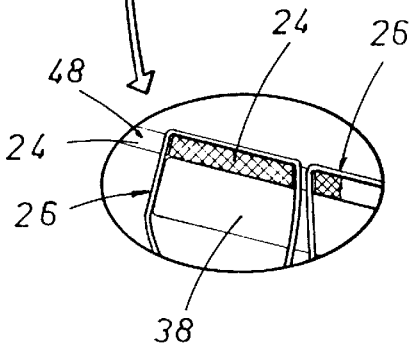

Referring to FIG. 4, each work head 55 and 56 of the knotting apparatus 54 will be seen to comprise:

a reaction element 37 offered in direct contact to the label 24, and to the thread 26 tensioned between the arms 6 of the gripper 5 and the supporting element 30 adjacent to the label 24; the reaction element 37 is capable of movement transversely to the wheel 4 between an operating position of association with the label 24, and a non-operative position distanced from the wheel 4 in such a way that rotation is not impeded;

a presser foot 38 offered to the label 24 in such a way that it is held against the reaction element 37; the presser foot 38 is capable of movement, coordinated with that of the reaction element 37, between an operating position of close proximity to the reaction element 37 and an at-rest position distanced from the reaction element 37, in which no obstacle is offered to the rotation of the wheel 4;

a needle 40 operating in conjunction with the reaction element 37 and the presser foot 38 and capable of movement, from an inactive position, through the label 24 toward an active position in which the thread 26 is picked up by means of a respective hook 41 (FIGS. 5 and 6), pulled through the label 24 as the needle returns toward the inactive position and drawn thus double into a loop 42, whereupon the needle 40 advances again toward the active position through a limited distance Y, rotating at the same time about its own axis 57, so that the loop 42 is widened to create an eye 58;

positioning means 43, capable of movement from an at-rest configuration in which the thread 26 remains tensioned solely between the supporting element 30 and the adjacent reaction element 37, to an active configuration in which the thread 26 is intercepted and tensioned in combination with the reaction element 37 and the presser foot 38 in such a way as to define a branch 44 facing the eye 58;

inserting means 45 (FIGS. 6, 7 and 8) which are capable of movement from an inactive position, on one side of the branch 44, to an active position in which the branch 44 is intercepted and directed through the eye 58 before the needle 40 disengages from the thread 26; and straightening means 46 by which the label 24 is drawn from the initially induced bent position to a final position of alignment with the bag 1, thereby pulling the loop 42 through the label 24 together with the inserted branch 44 and knotting the length 47 of thread 26 stably in one and the same movement.

Insofar as it relates to the structural details of the knotting apparatus 54, the foregoing description is intended as an essentially functional outline given that there are numerous ways ultimately in which the positioning, inserting and straightening means 43, 45 and 46 can be embodied, all equivalent in terms of the art.

Figure 13:
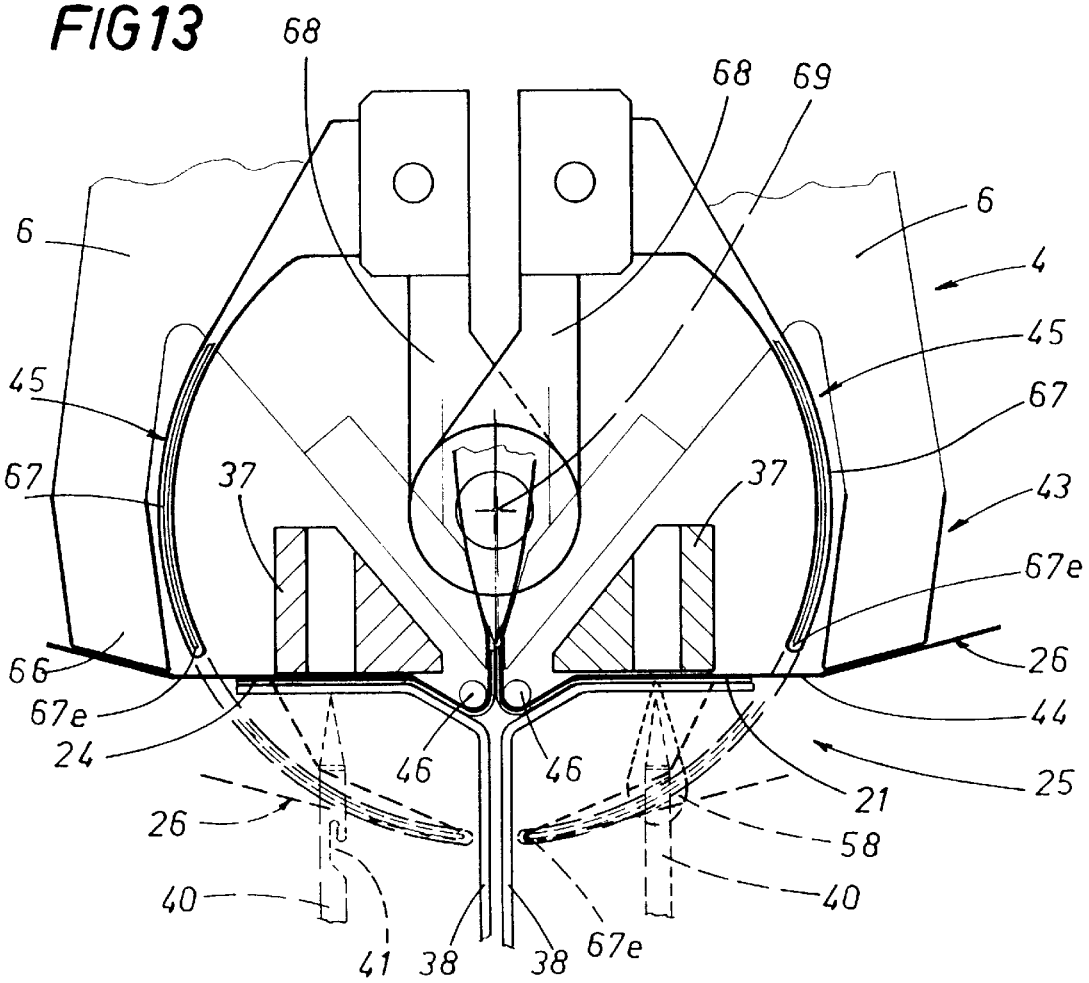
FIG. 13 illustrates one possible embodiment of a detail of the machine, suitably enlarged.

In the embodiment shown by way of example in FIG. 13, the means 43 of positioning the thread 26 are incorporated into the arms 6 of the gripper 4, each of which has a lateral appendage 66 projecting toward the thread 26 and combining with the adjacent reaction element 37 to prepare a branch 44 for insertion through the eye 58.

The inserting means 45 in this instance take the form of curvilinear intercepting elements 67 carried by respective arms 68 rotatable about an axis 69 coinciding with the center of curvature of the selfsame elements 67. The intercepting element 67 is set in motion by corresponding actuator means not illustrated in the drawings (e.g., a cam type mechanism) and which are capable thus of movement between a non-operating position located to one side of the branch 44 (bold lines in FIG. 13), and an operating position in which the tip 67*e* intercepts the thread 26 and directs it through the eye 58 in conventional manner (phantom lines in FIG. 13).

Figure 10:
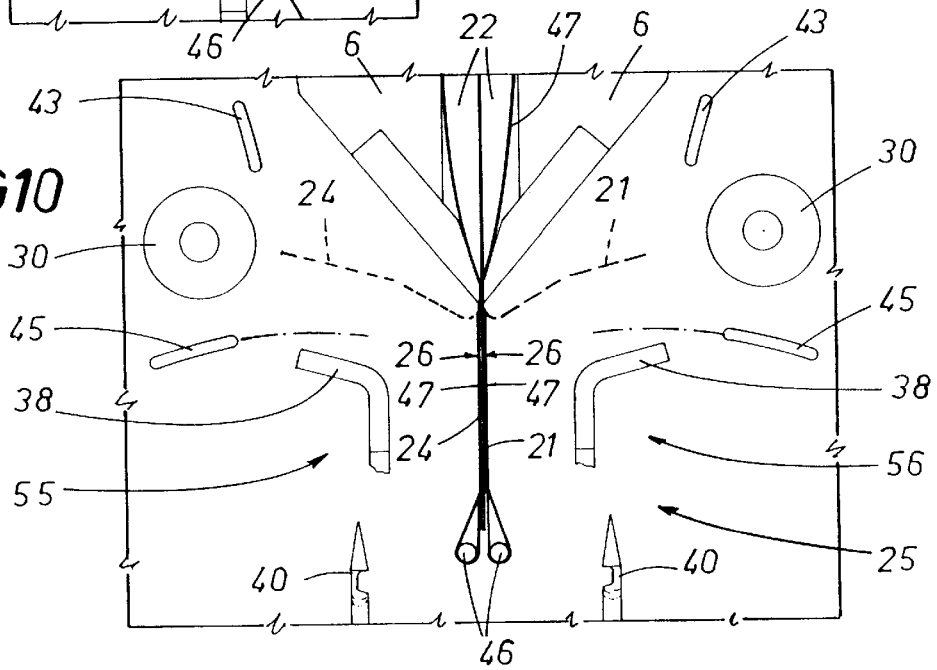

As already intimated, the same criteria can be applied in respect of the head 56 offered to the folded top 21 of the bag 21. It should be noted however, observing FIG. 10, that while the straightening means 46 operating on the label 24 are caused to disengage immediately from the thread 26 having fulfilled their function, the identical means 46 operating on the other side of the bag 1, having straightened the folded top 21, will first traverse laterally toward and effectively into the position occupied previously by the straightening means 46 operating on the label 24 before the thread 26 is released by a movement, for example, parallel to the axis 36 of rotation of the wheel 4.

The effect of these final movements described by the straightening means 46 operating on the folded top 21 is to insert the looped end 62 of the length 47 of thread 26 into the notch 48 (FIG. 11) and thus ensure the label 24 remains stably associated with the bag 1.

Figure 12:
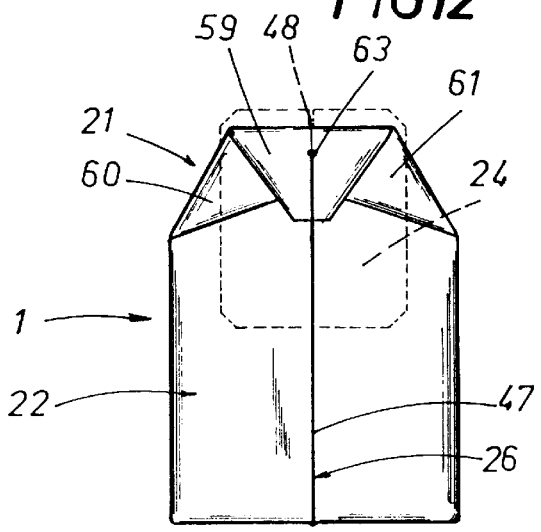

To ensure maximum effectiveness of the closure applied to the folded tops 21 of bags 1 manufactured by the machine 3 disclosed, a preferred solution will be to shape the top 21 as illustrated in FIG. 12, at the relative forming station 20, with at least three overlapping folds 59, 60 and 61 retained at a single point 63 by a knot formed in the manner described above.

Upon completion of the knotting operation at the fastening station 25, successive indexing movements of the wheel could take the bag 1 into a wrapping station 64 and thereafter to the outfeed station 50.

As discernible from the foregoing description, a further characteristic of the machine 3 according to the invention is that of its versatile structural embodiment, which will also allow the adoption of traditional fastening devices utilizing staples, and without any appreciable modifications required, should it be considered that such a solution poses no threat to the quality of the infusion as perceived by consumers. The same applies for other auxiliary work stations, which can be included or excluded with conspicuous ease.

I claim:

1. A machine for manufacturing in succession a plurality of filter bags, each containing a substance with which to prepare an infusion, and each furnished with a finger tab label attached by an interconnecting thread, each from an elongated tubular blank of filter paper filled with two measured and separate quantities of the substance, distributed along the length of the tubular blank, said machine comprising;

a wheel carrying a plurality of grippers, each having two radial arms, distributed about the periphery thereof;

a plurality of stations spaced from one another in succession around the periphery of the wheel, and including an infeed station, a folding station, a forming station, a cutting station, a feed station, and a fastening station;

the wheel being supported for indexed rotation about an axis of rotation so as to successively dispose each of the grippers at each of said stations;

said infeed station being arranged to supply the respective gripper, tangentially of the wheel, with a tubular blank of filter paper filled with two measured and separate quantities of the substance with which to prepare an infusion, to be held by the respective gripper;

said folding station including folding structure for folding the blank held by the respective gripper double about a pleat extending across an intermediate portion of the respective blank, to provide two resulting halves brought together; said folding structure including at least two stationary bearing elements disposed tangentially of the wheel and providing respective stationary surfaces which converge towards the wheel, and restraining elements supported for movement between said stationary surfaces, towards and away from the wheel, for restraining the respective tubular blank from opposite sides, taking up the respective tubular blank from said infeed station, folded in conjunction with said stationary surfaces to become a folded tubular blank, and directed between the respective said arms of the respective said grippers; said folding station further including supporting elements associated with the wheel on each side of each said gripper and arranged to hold a respective thread for connecting a label to a bag to be held across the respective said radial arms; and a reel arranged to have a supply of thread, for providing each respective said thread, to unreel therefrom due to tractive force as the wheel rotates, by having thread from said supply become engaged at a point between said stationary bearing elements by one of said restraining elements and be drawn between said radial arms of a respective said gripper, together with and so as to wrap around a respective folded tubular blank; said one of said restraining elements being arranged to then become distanced from the wheel, such that the wheel remains free to rotate in said indexed rotation;

said forming station including shaping structure for shaping opposite ends of the respective folded blank, while retained tightly between the respective said arms of the respective said gripper, together with a respective increment of threat from said supply of thread, into a folded top which constitutes a closure for a bag, comprising two envelopes, thereby made from the respective said folded blank;

said cutting station including a severing structure for severing said increment of thread from said supply to become a severed increment of thread;

said feed station including a feed structure for supplying a respective finger tab label from a supply of finger tab labels; and said fastening station including fastening structure for securing a respective said several increment of thread at one end to a respective said folded top of a respective said bag, and at an opposite end to a respective said finger tap label as fed by said feed structure of said feed station.

2. The machine of claim 1, wherein:

said restraining elements having matching profiles which are arranged to coact with one another to impress the pleat in the blank as the blank is being folded at said folding station.

3. The machine of claim 1, wherein:

the folding station further comprises at least two pressure elements arranged for movement in coordination with said restraining elements for pinning opposite ends of the respective tubular blank against said stationary surfaces in such a way as to prevent said measured and separate quantities of said substance from the respective tubular blank during indexing movement of the wheel for transferring the respective tubular blank from said infeed station to said folding station.

4. The machine of claim 1, wherein:

said supporting elements associated with the wheel comprise respective friction surfaces between which said thread from said supply of thread is free to slip as said wheel indexes, while remaining tensioned between each two successive, said supporting elements.

5. The machine of claim 1, wherein:

said one of said restraining elements is embodied in two parts which are supported for positive mutual engagement in a direction which is parallel to said axis of rotation of the wheel; at least one of said parts being supported for translational movement between an operating position, in which the respective said part is located between a respective said folded blank and the wheel, and a non-operating position, in which the respective said part is distanced axially from the wheel in such a way that the wheel is free to be rotationally indexed about said axis of rotation.

6. The machine of claim 1, wherein:

said supporting elements are associated with the wheel by being carried by the respective said radial arms of said grippers.

7. The machine of claim 3, wherein:

said pressure elements are mounted so as to be caused to interact with said stationary surfaces only during an interval of time during which each said blank is being accelerated through said folding station towards the wheel.

8. The machine of claim 4, wherein:

said said friction surfaces are arranged on said supporting elements so as to be mutually opposed and said supporting elements are arranged so as to spring load said friction surfaces towards one another.

9. The machine of claim 1, wherein:

said fastening structure at said fastening station comprises a knotting apparatus, comprising:

a reaction element arranged to offered to the respective said finger tab label and to the respective said increment of thread while the respective said increment of thread is tensioned between the respective radial arms of a respective said gripper and a respective said one supporting element adjacent to the respective said finger tab label; said reaction element being mounted for movement transversely of the wheel between and in which the reaction element is associated with the respective said finger tab label, and a non-operating position in which said reaction element is so distanced from the wheel as not to impede indexing rotation of the wheel about said axis of rotation;

a presser foot supported for engaging the respective said finger tab label and thereby holding the respective said finger tab label against said reaction element, and for moving, in coordination with movement of said reaction element, between an operating position of close proximity to said reaction element, and an at-rest position in which said presser foot offers no impediment to indexing rotation of the wheel about said axis of rotation;

a needle having a hood and supported for operation in conjunction with said reaction element and said presser foot for movement along a longitudinal axis thereof from an inactive position, through the respective said finger tab label, toward an active position in which the respective said increment of thread is picked-up by said hook, and pulled through the respective said finger tab label as said needle is returned to said inactive position, thereby drawing said increment of thread double into a loop, whereupon the needle is advanced again a limited distance towards said active position while being rotated about said longitudinal axis thereby widening said loop into an eye and is thereafter disengaged from said increment of thread;

positioning means supported for operation in conjunction with said reaction element and said presser foot for tensioning said increment of thread to establish a branch of said increment of thread, facing said eye;

an inserting means supported for movement between an inactive position in which said inserting means is located alongside said branch, and an active position in which said inserting means intercepts said branch and directs said branch through said eye before said needle is disengaged from said increment of thread; and straightening means supported for drawing the respective said finger tab label from a position of being bent in relation to the respective said bag, to a position of alignment with the respective said bag, and thereby pulling said loop through the respective said finger tab label, together with said branch and stably knotting said increment of thread, all in one movement.

10. The machine of claim 1, wherein said fastening structure at said fastening station comprises a knotting apparatus, comprising:

a reaction element arranged to offered to the respective said folded top and to the respective said increment of thread while the respective said increment of thread is tensioned between the respective radial arms of a respective said gripper and a respective said one supporting element adjacent to the respective said folded top; said reaction element being mounted for movement transversely of the wheel between and in which the reaction element is associated with the respective said folded top, and a non-operating position in which said reaction element is so distanced from the wheel as not to impede indexing rotation of the wheel about said axis of rotation;

a presser foot supported for engaging the respective said folded top and thereby holding the respective said folded top against said reaction element, and for moving, in coordination with movement of said reaction element, between an operating position of close proximity to said reaction element, and an at-rest position in which said presser foot offers no impediment to indexing rotation of the wheel about said axis of rotation;

a needle having a hood and supported for operation in conjunction with said reaction element and said presser foot for movement along a longitudinal axis thereof from an inactive position, through the respective said folded top, toward an active position in which the respective said increment of thread is picked-up by said hook, and pulled through the respective said folded top as said needle is returned to said inactive position, thereby drawing said increment of thread double into a loop, whereupon the needle is advanced again a limited distance towards said active position while being rotated about said longitudinal axis thereby widening said loop into an eye and is thereafter disengaged from said increment of thread;

positioning means supported for operation in conjunction with said reaction element and said presser foot for tensioning said increment of thread to establish a branch of said increment of thread, facing said eye;

an inserting means supported for movement between an inactive position in which said inserting means is located alongside said branch, and an active position in which said inserting means intercepts said branch and directs said branch through said eye before said needle is disengaged from said increment of thread; and straightening means supported for drawing the respective said folded top label from a position of being bent in relation to the respective said bag, to a position of alignment with the respective said bag, and thereby pulling said loop through the respective said folded top, together with said branch and stably knotting said increment of thread, all in one movement.

11. The machine of claim 10, for manufacturing filter bags in which each said finger tab label has a notch, wherein:

said straightening means are further supported for movement transversely of the respective said finger tab label, after having drawing the respective said folded top into alignment with the respective said bag, such as to cause a doubled end portion of the respective said increment of thread to be inserted into a respective said notch.

12. The machine of claim 9 or claim 10, wherein:

said positioning means comprise an appendage provided on one said arm of each gripper and arranged to project towards the respective increment of thread and to coact with said reaction element establish said branch of said increment of thread.

13. The machine of claim 9 or claim 10, wherein:

said inserting means comprise an intercepting element carried by a movable arm for movement between a non-operating position in which said intercepting element is located alongside said branch, and an operating position in which said branch is directed through said eye.

14. A filter bag made by the method of claim 1.

15. A filter bag according to claim 14, wherein:

said folded top has at least three overlapping folds which are secured to one another at a single fastening point by said increment of thread.

16. A filter bag according to claim 15, wherein:

said increment of thread is knotted to secure said three overlapping folds to one another at said single fastening point.

17. A filter bag according to claim 14, wherein:

said finger tap label has a notch formed in an edge thereof, and said increment of thread, between said bag and said finger tab label wraps around said bag and is caught in said notch.

* * * * *